US010133289B1

(12) United States Patent
Ankamreddi et al.

(10) Patent No.: US 10,133,289 B1
(45) Date of Patent: Nov. 20, 2018

(54) VOLTAGE REGULATOR CIRCUITS WITH PASS TRANSISTORS AND SINK TRANSISTORS

(71) Applicant: TEXAS INSTRUMENTS INCORPORATED, Dallas, TX (US)

(72) Inventors: Ramakrishna Ankamreddi, Bengaluru (IN); Rohit Phogat, Bengaluru (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/878,530

(22) Filed: Jan. 24, 2018

Related U.S. Application Data

(60) Provisional application No. 62/612,257, filed on Dec. 29, 2017.

(30) Foreign Application Priority Data

May 16, 2017 (IN) ..... 201741017075

(51) Int. Cl.
*G05F 1/595* (2006.01)
*G05F 1/46* (2006.01)
*G05F 1/575* (2006.01)

(52) U.S. Cl.
CPC ..... *G05F 1/595* (2013.01); *G05F 1/468* (2013.01); *G05F 1/575* (2013.01)

(58) Field of Classification Search
CPC ..... H02M 3/135; H02M 3/155–3/158; H02M 3/145; G05F 1/46; G05F 1/468; G05F 1/595; G05F 1/56; G05F 1/575
USPC ..... 323/265, 268, 270, 271, 273–275, 323/282–285, 351
See application file for complete search history.

(56) References Cited

U.S. PATENT DOCUMENTS 6,861,827 B1 * 3/2005 Yang ..... G05F 3/262 323/273
9,778,672 B1 * 10/2017 Gao ..... G05F 1/575
2015/0311692 A1 * 10/2015 Hiyama ..... H03K 17/0828 361/31
2015/0378379 A1 * 12/2015 Bhattad ..... G05F 1/575 323/280
2016/0124448 A1 * 5/2016 Murukumpet ..... G05F 1/59 323/268
2017/0063223 A1 * 3/2017 Raghupathy ..... H02M 3/07
2018/0052481 A1 * 2/2018 Aboudina ..... G05F 3/267

* cited by examiner

*Primary Examiner* — Adolf Berhane
(74) *Attorney, Agent, or Firm* — Tuenlap D. Chan; Charles A. Brill; Frank D. Cimino

(57) ABSTRACT

A voltage regulator circuit comprises: a pass transistor comprising a gate, a source, and a drain; an error amplifier comprising an output port coupled to the gate of the pass transistor, a first input port, and a second input port; a feedback circuit coupled to the drain of the pass transistor, and coupled to the first input port of the error amplifier to provide a feedback voltage at the first input port of the error amplifier; a sink transistor comprising a gate, a source, and a drain coupled to the drain of the pass transistor; a sink gate voltage circuit coupled to the gate of the sink transistor to provide a gate voltage at the gate of the sink transistor; and a pass gate sensing circuit coupled to the output port of the error amplifier to provide current to the sink gate voltage circuit.

20 Claims, 3 Drawing Sheets

VOLTAGE REGULATOR CIRCUITS WITH PASS TRANSISTORS AND SINK TRANSISTORS

CROSS-REFERENCE TO RELATED APPLICATIONS

The present application claims priority to U.S. Provisional Patent Application No. 62/612,257, which was filed Dec. 29, 2017, is titled "Voltage Regulator Circuits With Pass Transistors And Sink Transistors" and Indian Provisional Patent Application No. 201741017075, which was filed May 16, 2017, is titled "A Zero Shoot-Through Current, High Accuracy, Ultra-Low IQ Linear Regulator With Source And Sink Capability Using Single Error Amplifier," and are hereby incorporated herein by reference in their entirety.

BACKGROUND

Voltage regulator circuits regulate the output voltage at an output port, where the value to which the output voltage is regulated depends upon a feedback path and a reference voltage. Many voltage regulators utilize a pass transistor to source current to a load, where the pass transistor is controlled by way of feedback to regulate the output voltage provided to a load. In some applications, a voltage regulator circuit is part of a system in which other devices, loads, or circuits may at times inject current into the output port of the voltage regulator circuit, thereby raising the output voltage above the desired value.

SUMMARY

In accordance with a first set of embodiments, a voltage regulator circuit comprises: a pass transistor comprising a gate, a source, and a drain; an error amplifier comprising an output port coupled to the gate of the pass transistor, a first input port, and a second input port; a feedback circuit coupled to the drain of the pass transistor, and coupled to the first input port of the error amplifier to provide a feedback voltage at the first input port of the error amplifier; a sink transistor comprising a gate, a source, and a drain coupled to the drain of the pass transistor; a sink gate voltage circuit coupled to the gate of the sink transistor to provide a gate voltage at the gate of the sink transistor; and a pass gate sensing circuit coupled to the output port of the error amplifier to provide current to the sink gate voltage circuit.

In accordance with the first set of embodiments, the voltage regulator circuit further comprises a reference voltage source to provide a reference voltage at the second input port of the error amplifier.

In accordance with the first set of embodiments, the voltage regulator circuit further comprises an input voltage source to provide an input voltage at the source of the pass transistor.

In accordance with the first set of embodiments, the voltage regulator circuit further comprises an output capacitor coupled to the drain of the pass transistor, and a load coupled to the drain of the pass transistor.

In accordance with the first set of embodiments, the voltage regulator circuit further comprises a buffer comprising an input port coupled to the output port of the error amplifier, and an output port coupled to the gate of the pass transistor.

In accordance with the first set of embodiments, in the voltage regulator circuit, the pass gate sensing circuit comprises: a first transistor comprising a gate, a source, and a drain connected to the gate of the first transistor; a bias current sink coupled to the drain of the first transistor; and a second transistor comprising a gate coupled to the gate of the first transistor, a source coupled to the output port of the error amplifier, and a drain coupled to the sink gate voltage circuit and to the gate of the sink transistor.

In accordance with the first set of embodiments, in the voltage regulator circuit, the sink gate voltage circuit comprises a resistor coupled to the drain of the second transistor.

In accordance with the first set of embodiments, in the voltage regulator circuit, the sink gate voltage circuit further comprises a diode-connected transistor coupled in series with the resistor.

In accordance with the first set of embodiments, in the voltage regulator circuit, the feedback circuit comprises: a first resistor comprising a first terminal coupled to the drain of the pass transistor, and a second terminal coupled to the first input port of the error amplifier; and a second resistor comprising a terminal connected to the second terminal of the first resistor.

In accordance with the first set of embodiments, in the voltage regulator circuit, the sink gate voltage circuit comprises a resistor coupled to the pass gate sensing circuit.

In accordance with the first set of embodiments, in the voltage regulator circuit, the feedback circuit comprises: a first resistor comprising a first terminal coupled to the drain of the pass transistor, and a second terminal coupled to the first input port of the error amplifier; and a second resistor comprising a terminal connected to the second terminal of the first resistor.

In accordance with the first set of embodiments, in the voltage regulator circuit, the pass transistor is a p-metal-oxide-semiconductor field-effect-transistor (pMOSFET); and the sink transistor is an n-metal-oxide-semiconductor field-effect-transistor (nMOSFET).

In accordance with a second set of embodiments, a circuit comprises: a pass transistor comprising a gate, a source, and a drain; an error amplifier comprising an output port coupled to the gate of the pass transistor, a first input port, and a second input port; a sink transistor comprising a gate, a source, and a drain connected to the drain of the pass transistor; a first transistor comprising a gate, a source, and a drain connected to the gate of the first transistor; a bias current sink connected to the drain of the first transistor; and a second transistor comprising a gate connected to the gate of the first transistor, a source connected to the output port of the error amplifier, and a drain connected to the gate of the sink transistor.

In accordance with the second set of embodiments, the circuit further comprises a resistor coupled to the drain of the second transistor.

In accordance with the second set of embodiments, the circuit further comprises a diode-connected transistor connected in series with the resistor.

In accordance with the second set of embodiments, the circuit further comprises an input voltage source to source current to the source of the first transistor.

In accordance with a third set of embodiments, a circuit comprises: a pass transistor comprising a gate, a source, and a drain, the gate too have a voltage; an error amplifier coupled to the pass transistor to control the gate voltage of the pass transistor, the error amplifier comprising a first input port and a second input port; a sink transistor comprising a gate, a source, and a drain connected to the drain of the pass transistor, the gate of the sink transistor to have a voltage; a pass gate sensing circuit coupled to the error amplifier to source an error current; and a sink gate voltage circuit coupled to the pass gate sensing circuit, the sink gate voltage circuit to provide the gate voltage of the sink transistor in response to the error current.

In accordance with the third set of embodiments, the circuit further comprises: a load coupled to the drain of the pass transistor; and a feedback circuit coupled to the pass transistor to provide a feedback voltage at the first input port of the error amplifier, the feedback voltage in response to the pass transistor providing an output voltage to the load.

In accordance with the third set of embodiments, the circuit further comprises: a reference voltage source to provide a reference voltage at the second input port of the error amplifier; and an input voltage source to provide an input voltage at the source of the pass transistor.

BRIEF DESCRIPTION OF THE DRAWINGS

For a detailed description of various examples, reference will now be made to the accompanying drawings in which.

DETAILED DESCRIPTION

In accordance with the disclosed embodiments, a voltage regulator circuit comprises a pass transistor and a sink transistor to regulate the output voltage at an output port of the voltage regulator circuit. The voltage regulator circuit includes circuitry to sense when the pass transistor is turned OFF due to current injected into the output port, where the circuitry causes the sink transistor to turn ON to sink the injected current. The circuitry prevents the sink transistor and the pass transistor from turning ON at the same time, thereby preventing shoot-through current. Embodiments need only one feedback path and one error amplifier to control both the sink transistor and the pass transistor, thereby simplifying the design of stable voltage regulator circuits that have both source and sink capabilities.

Figure 1:
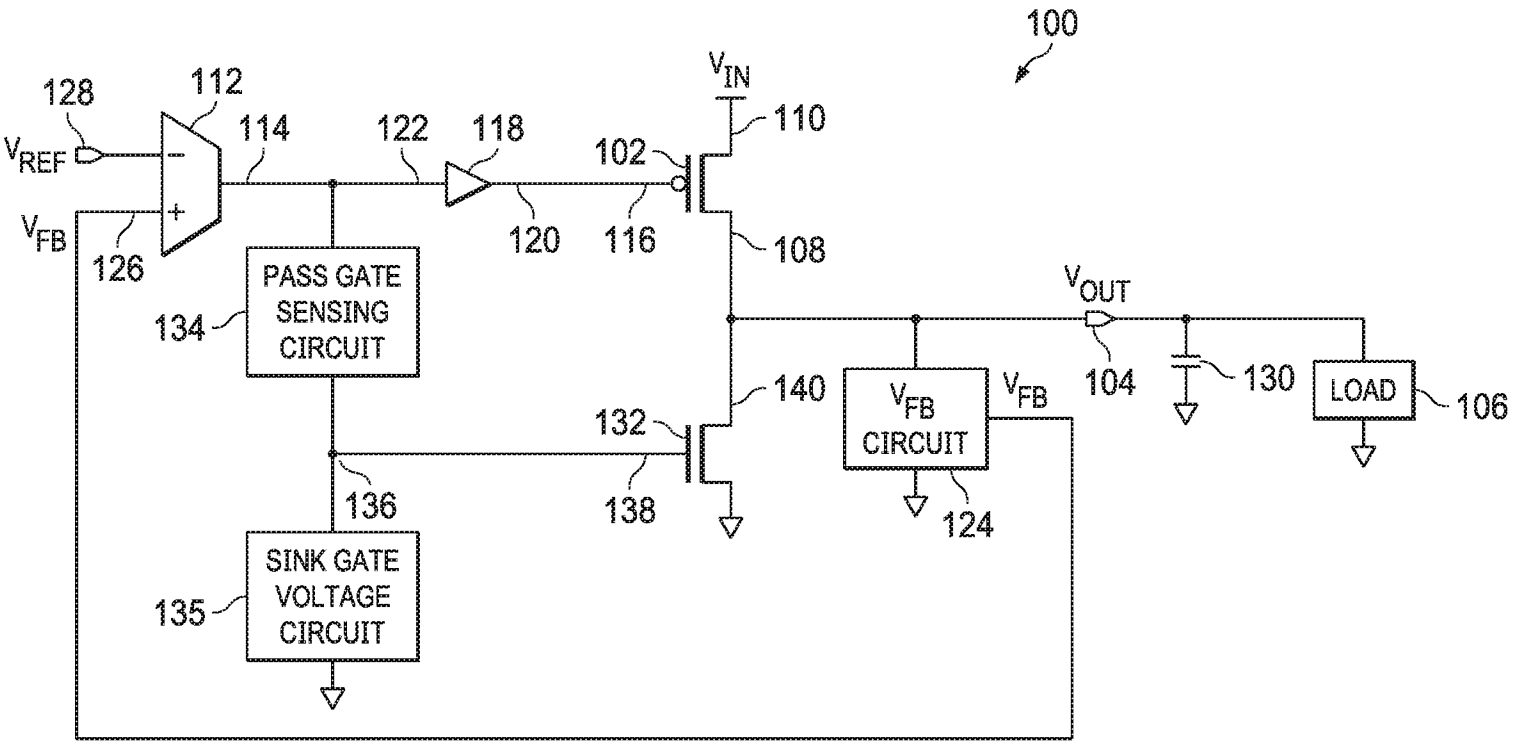
FIG. 1 shows a circuit in accordance with various examples.

FIG. 1 shows an illustrative circuit 100. The illustrative circuit 100 is a voltage regulator circuit that, when in operation, can source current or sink current so as to regulate an output voltage. When the illustrative circuit 100 is sourcing current, a pass transistor 102 is controlled to source current so as to regulate the output voltage provided at an output port 104 to a load 106. In the embodiment of FIG. 1, the pass transistor 102 is a p-metal-oxide-semiconductor field-effect-transistor (pMOSFET). A drain 108 of the pass transistor 102 is connected to the output port 104. During operation of the illustrative circuit 100, an input voltage is provided at a source 110 of the pass transistor 102.

An error amplifier 112 includes an output port 114 coupled to a gate 116 of the pass transistor 102. In the embodiment of FIG. 1, a buffer 118 includes an output port 120 connected to the gate 116 of the pass transistor 102, and an input port 122 connected to the output port 114 of the error amplifier 112. In some embodiments, the error amplifier 112 can include the functionality of the buffer 118 so that the output port 114 of the error amplifier 112 is connected to the gate 116 of the pass transistor 102.

A feedback circuit 124 is connected to the drain 108 of the pass transistor 102. During operation when the pass transistor 102 is sourcing current, the feedback circuit 124 provides a feedback voltage at an input port 126 of the error amplifier 112. The feedback voltage is in response to the output voltage developed at the output port 104. As a particular example, the feedback voltage is proportional to the output voltage at the output port 104, where the proportionality factor is less than one.

The error amplifier 112 includes an input port 128. During operation, a reference voltage is provided at the input port 128 of the error amplifier 112. In some embodiments, the error amplifier 112 is a high-gain transconductance amplifier that provides an output current at the output port 114 in response to the difference between the voltages at its input ports.

When the pass transistor 102 is sourcing current to the load 106, the error amplifier 112 controls the gate voltage of the pass transistor 102 to regulate the output voltage at the output port 104 by comparing the feedback voltage at the input port 126 to the reference voltage at the input port 128. The output voltage at the output port 104 is regulated to a desired value determined by the reference voltage provided at the input port 128 and the relationship of the feedback voltage to the output voltage. For example, if the feedback voltage is proportional to the output voltage, where the proportionality factor is c, then the illustrative circuit 100 is designed to regulate the output voltage to $cV_{REF}$, where $V_{REF}$ is the value of the reference voltage provided at the input port 128. Usually, an output capacitor 130 is connected to the output port 104 to stabilize the illustrative circuit 100.

When the pass transistor 102 is sourcing current to the load 106, a sink transistor 132 is OFF. In many applications, the illustrative circuit 100 is included in a system (not shown) with other circuits, loads, and devices, where in some circumstances a current may at times be injected into the output port 104. This injected current may cause the output voltage at the output port 104 to exceed the desired value, so that the error amplifier 112 causes the pass transistor 102 to turn OFF. Under such circumstances, the sink transistor 132 turns ON to sink the injected current to help regulate the output voltage at the output port 104. In the embodiment of FIG. 1, the sink transistor is an n-metal-oxide-semiconductor field-effect-transistor (nMOSFET).

A pass gate sensing circuit 134 is coupled to the output port 114 of the error amplifier 112. When the current provided by the error amplifier 112 is sufficient to cause the pass transistor 102 to turn OFF, the pass gate sensing circuit 134 sources this current to a sink gate voltage circuit 135. In the description of embodiments, the current provided by the error amplifier 112 that is sourced by the pass gate sensing circuit 134 to the sink gate voltage circuit 135 is referred to as an error current. Some of the current provided by the error amplifier 112 is leaked to ground, such as for example, through the output resistance of the error amplifier 112 and through the input resistance of the buffer 118. In practice, this leakage current is very small, so that error current provided by the pass gate sensing circuit 134 to the sink gate voltage circuit 135 is nearly equal to the current provided at the output port 114 of the error amplifier 112.

The sink gate voltage circuit 135, in response to the error current, develops a voltage at a node 136. The node 136 is connected to a gate 138 of the sink transistor 132, and a drain 140 of the sink transistor 132 is connected to the output port 104 and to the drain 108 of the pass transistor 102. When the voltage developed at the node 136 rises to the threshold voltage of the sink transistor 132, the sink transistor 132 turns ON to sink current from the output port 104, so as to help regulate the output voltage at the output port 104.

The pass gate sensing circuit 134 and the sink gate voltage circuit 135 are designed so that the sink transistor 132 is only ON when the pass transistor 102 is OFF. In this way, shoot-through current is avoided.

As the current at the output port 114 decreases in response to the sink transistor 132 sufficiently sinking current that has been injected into the output port 104, the voltage at the node 136 decreases to where the sink transistor 132 turns OFF. The sink transistor 132 is turned OFF before the pass transistor 102 is turned ON.

Figure 2:
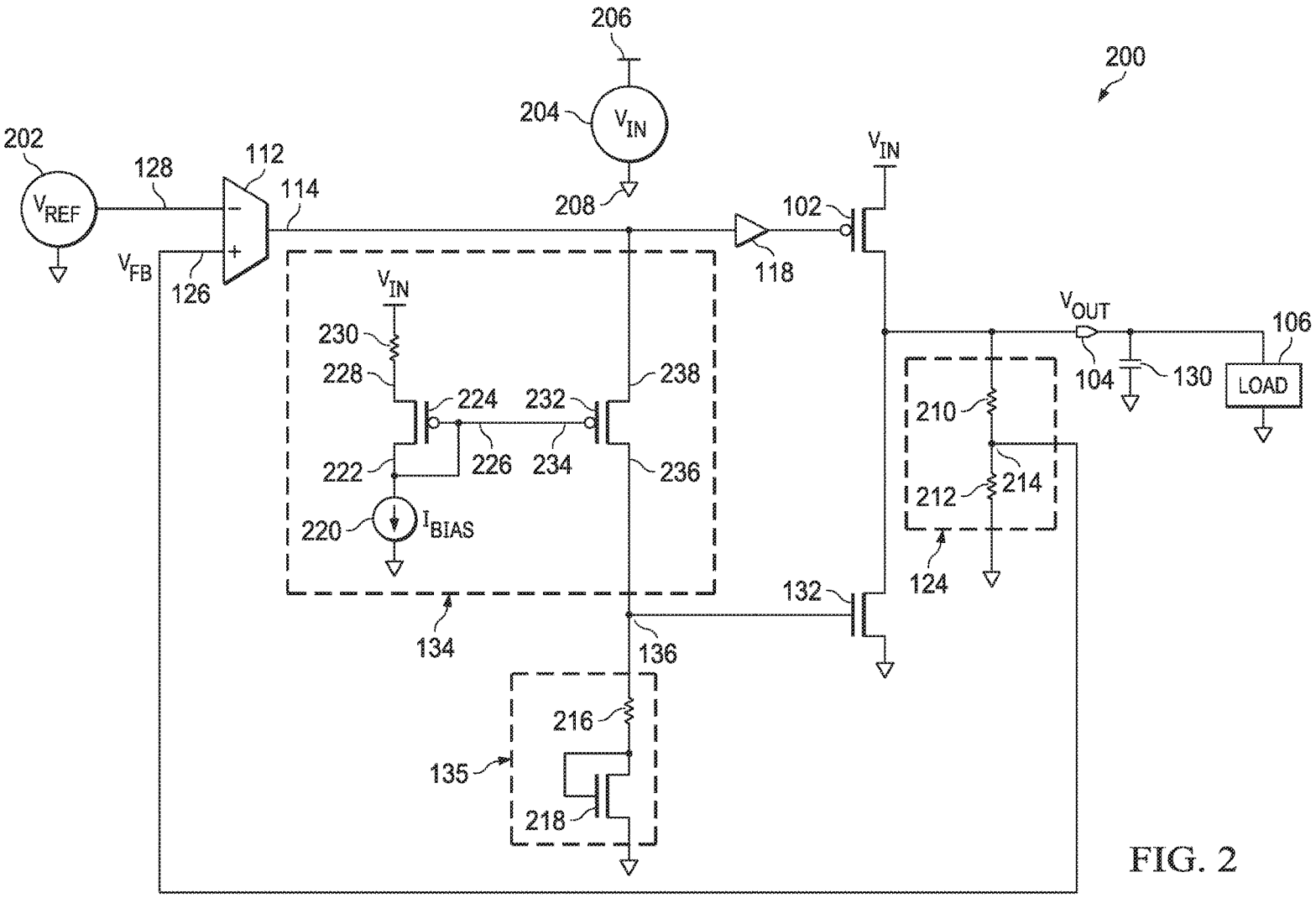
FIG. 2 shows a circuit in accordance with various examples.

FIG. 2 shows an illustrative circuit 200. The illustrative circuit 200 is a voltage regulator circuit according to the illustrative circuit 100, where specific embodiments are illustrated for the feedback circuit 124, the pass gate sensing circuit 134, and the sink gate voltage circuit 135. FIG. 2 shows a reference voltage source 202 to provide the reference voltage $V_{REF}$ at the input port 128, and an input voltage source 204 to provide the input voltage $V_{IN}$ to various components of the illustrative circuit 200, such as for example a supply rail 206. (The source of the pass transistor 102 is connected to the supply rail 206.) These voltages are referenced to ground or substrate, e.g., a ground 208.

In the embodiment of FIG. 2, the feedback circuit 124 is a voltage divider circuit, comprising serially-connected resistors 210 and 212. The feedback voltage is developed at a node 214, where terminals of the resistors 210 and 212 are connected to the node 214.

In the embodiment of FIG. 2, the sink gate voltage circuit 135 comprises a resistor 216 connected in series with a diode-connected transistor 218. In some embodiments, the diode-connected transistor 218 may be absent, where the resistor 216 is connected to ground 208. In some embodiments, the relative ordering of the resistor 216 and the diode-connected transistor 218 can be reversed so that the resistor 216 is connected to ground 208 and the diode-connected transistor 218 is connected to the node 136. In other embodiments, other combinations of circuit elements can be used to realize the sink gate voltage circuit 135, such that the voltage developed at the node 136 is in general a non-decreasing function of the error current sourced into the sink gate voltage circuit 135.

In the embodiment of FIG. 2, the pass gate sensing circuit 134 includes a bias current sink 220, a transistor 224, and a resistor 230. The bias current sink 220 is coupled to the transistor 224 to sink a bias current from a drain 222 of the transistor 224. A gate 226 of the transistor 224 is connected to the drain 222. A source 228 of the transistor 224 is connected to the resistor 230. The resistor 230 is biased at the input voltage provided by the supply rail 206. The voltage at the source 228 is $V_{IN}-I_{BIAS}R$, where $I_{BIAS}$ is the bias current provided by the bias current sink 220, and R is the resistance of the resistor 230. In the embodiment of FIG. 2, the transistor 224 is a pMOSFET.

The pass gate sensing circuit 134 includes a transistor 232. The transistor 232 includes a gate 234 connected to the gate 226, a drain 236 connected to the sink gate voltage circuit 135 (at the node 136), and a source 238 connected to the output port 114 of the error amplifier 112. In the embodiment of FIG. 2, the transistor 232 is a pMOSFET.

When the pass transistor 102 is sourcing current to the load 106, the illustrative circuit 200 is designed such that the voltage developed at the source 238 of the transistor 232 is sufficiently less than the voltage $V_{IN}-I_{BIAS}R$ developed at the source 228 to keep the transistor 232 from conducting the error current to the sink gate voltage circuit 135. When current is injected into the output port 104 so that the feedback voltage is sufficiently larger than the reference voltage to cause the error current to increase and turn OFF the pass transistor 102, the voltage developed at the source 238 starts to rise. When this voltage approaches the voltage $V_{IN}-I_{BIAS}R$ developed at the source 228, the transistor 232 is sufficiently turned ON to source the error current to the sink gate voltage circuit 135. The voltage at the node 136 rises to the threshold voltage of the sink transistor 132 to turn it ON.

With the sink transistor 132 turned ON to sink current from the output port 104, the feedback voltage eventually drops to a value where the transistor 232 stops sourcing the error current to the sink gate voltage circuit 135. This causes the voltage at the node 136 to drop below the threshold voltage of the sink transistor 132 so that it is turned OFF before the pass transistor 102 is turned ON.

Figure 3:
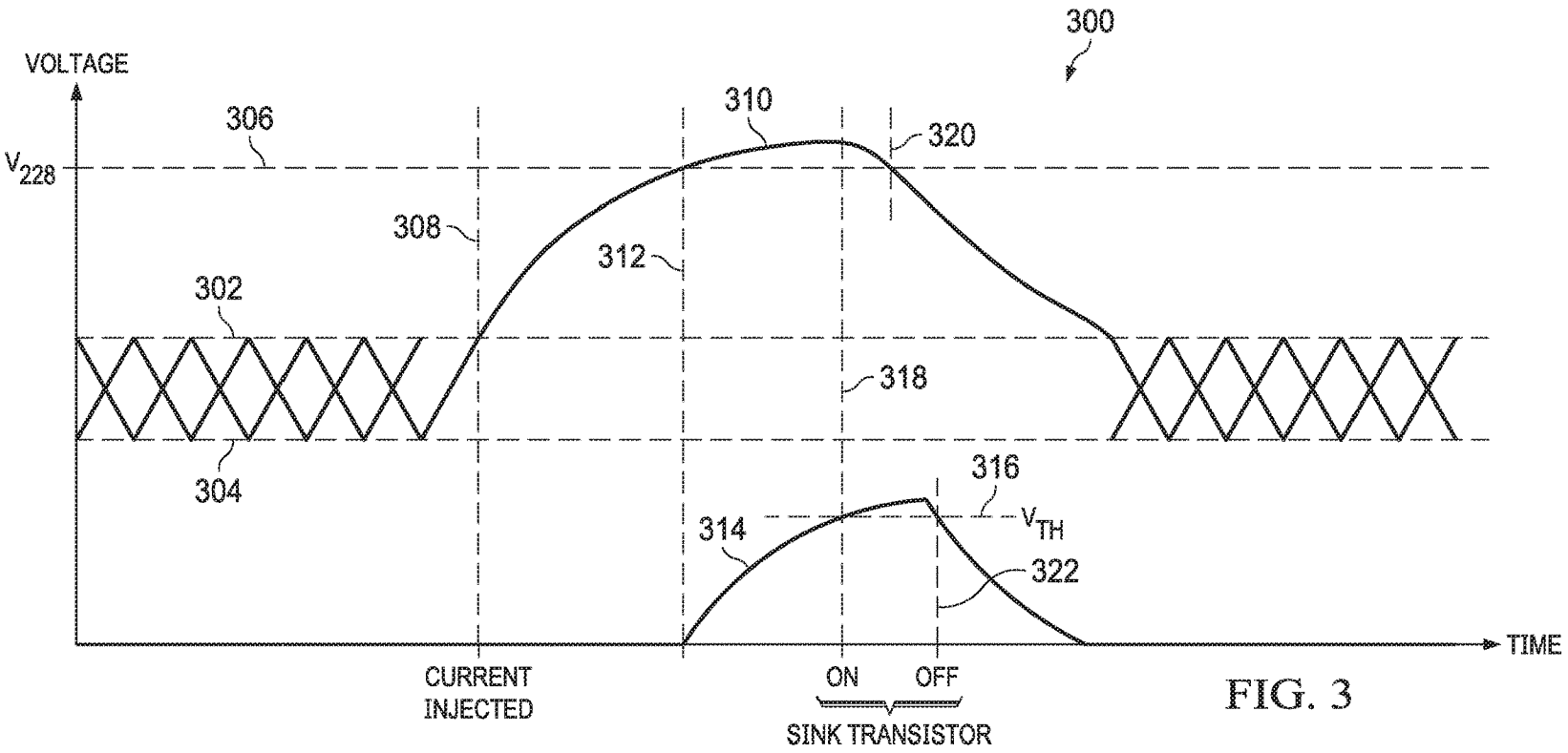
FIG. 3 shows a timing diagram accordance with various examples.

FIG. 3 shows an illustrative timing diagram 300 for the illustrative circuit 100 or the illustrative circuit 200, with the y-axis representing voltage and the x-axis representing time. Dashed lines 302 and 304 represent an operating range for the voltage at the input port 122 of the buffer 118 (or equivalently, the voltage at the output port 114 of the error amplifier 112 or the source 238 of the transistor 232) when the sink transistor 132 is OFF. A dashed line 306 represents the voltage at the source 228 of the transistor 224.

A dashed line 308 represents a time when current is injected into the output port 104 and causes the voltage at the input port 122, represented by a curve 310, to rise outside of the operating range represented by the dashed lines 302 and 304. A dashed line 312 represents a time at which the voltage at the input port 122 rises to the voltage at the source 228 of the transistor 224, thereby causing the voltage at the gate 138 of the sink transistor 132 to rise, represented by a curve 314. Dashed line 316 represents the threshold voltage of the sink transistor 132.

When the voltage at the gate 138 of the sink transistor 132 rises to the threshold voltage of the sink transistor 132, the sink transistor 132 turns ON, represented by a curve 318. With the sink transistor 132 ON, the voltage at the input port 122 eventually falls below the voltage at the source 228 of the transistor 224, represented by a dashed line 320. The voltage at the gate 138 of the sink transistor 132 eventually falls below the threshold voltage of the sink transistor 132, represented by a dashed line 322, thereby turning OFF the sink transistor 132.

The above discussion is meant to be illustrative of the principles and various embodiments of the present disclosure. Numerous variations and modifications will become apparent to those skilled in the art once the above disclosure is fully appreciated. It is intended that the following claims be interpreted to embrace all such variations and modifications.

What is claimed is:

1. A voltage regulator circuit, the circuit comprising:

a pass transistor comprising a gate, a source, and a drain;

an error amplifier comprising an output port coupled to the gate of the pass transistor, a first input port, and a second input port;

a feedback circuit coupled to the drain of the pass transistor, and coupled to the first input port of the error amplifier to provide a feedback voltage at the first input port of the error amplifier;

a sink transistor comprising a gate, a source, and a drain coupled to the drain of the pass transistor;

a sink gate voltage circuit coupled to the gate of the sink transistor to provide a gate voltage at the gate of the sink transistor; and a pass gate sensing circuit coupled to the output port of the error amplifier to provide current to the sink gate voltage circuit.

2. The voltage regulator circuit of claim 1, further comprising:

a reference voltage source to provide a reference voltage at the second input port of the error amplifier.

3. The voltage regulator circuit of claim 1, further comprising:

an input voltage source to provide an input voltage at the source of the pass transistor.

4. The voltage regulator circuit of claim 1, further comprising:

an output capacitor coupled to the drain of the pass transistor; and a load coupled to the drain of the pass transistor.

5. The voltage regulator circuit of claim 1, further comprising:

a buffer comprising an input port coupled to the output port of the error amplifier, and an output port coupled to the gate of the pass transistor.

6. The voltage regulator circuit of claim 1, wherein the pass gate sensing circuit comprises:

a first transistor comprising a gate, a source, and a drain connected to the gate of the first transistor;

a bias current sink coupled to the drain of the first transistor; and a second transistor comprising a gate coupled to the gate of the first transistor, a source coupled to the output port of the error amplifier, and a drain coupled to the sink gate voltage circuit and to the gate of the sink transistor.

7. The voltage regulator circuit of claim 6, wherein the sink gate voltage circuit comprises:

a resistor coupled to the drain of the second transistor.

8. The voltage regulator circuit of claim 7, wherein the sink gate voltage circuit further comprises:

a diode-connected transistor coupled in series with the resistor.

9. The voltage regulator circuit of claim 8, wherein the feedback circuit comprises:

a first resistor comprising a first terminal coupled to the drain of the pass transistor, and a second terminal coupled to the first input port of the error amplifier; and a second resistor comprising a terminal connected to the second terminal of the first resistor.

10. The voltage regulator circuit of claim 1, wherein the sink gate voltage circuit comprises:

a resistor coupled to the pass gate sensing circuit.

11. The voltage regulator circuit of claim 10, wherein the sink gate voltage circuit further comprises:

a diode-connected transistor coupled in series with the resistor.

12. The voltage regulator circuit of claim 1, wherein the feedback circuit comprises:

a first resistor comprising a first terminal coupled to the drain of the pass transistor, and a second terminal coupled to the first input port of the error amplifier; and a second resistor comprising a terminal connected to the second terminal of the first resistor.

13. The voltage regulator circuit of claim 1, wherein the pass transistor is a p-metal-oxide-semiconductor field-effect-transistor (pMOSFET); and the sink transistor is an n-metal-oxide-semiconductor field-effect-transistor (nMOSFET).

14. A circuit comprising:

a pass transistor comprising a gate, a source, and a drain;

an error amplifier comprising an output port coupled to the gate of the pass transistor, a first input port, and a second input port;

a sink transistor comprising a gate, a source, and a drain connected to the drain of the pass transistor;

a first transistor comprising a gate, a source, and a drain connected to the gate of the first transistor;

a bias current sink connected to the drain of the first transistor; and a second transistor comprising a gate connected to the gate of the first transistor, a source connected to the output port of the error amplifier, and a drain connected to the gate of the sink transistor.

15. The circuit of claim 14, further comprising:

a resistor coupled to the drain of the second transistor.

16. The circuit of claim 15, further comprising:

a diode-connected transistor connected in series with the resistor.

17. The circuit of claim 16, further comprising:

an input voltage source to source current to the source of the first transistor.

18. A circuit comprising:

a pass transistor comprising a gate, a source, and a drain, the gate to have a voltage;

an error amplifier coupled to the pass transistor to control the gate voltage of the pass transistor, the error amplifier comprising a first input port and a second input port;

a sink transistor comprising a gate, a source, and a drain connected to the drain of the pass transistor, the gate of the sink transistor to have a voltage;

a pass gate sensing circuit coupled to the error amplifier to source an error current; and a sink gate voltage circuit coupled to the pass gate sensing circuit, the sink gate voltage circuit to provide the gate voltage of the sink transistor in response to the error current.

19. The circuit of claim 18, further comprising:

a load coupled to the drain of the pass transistor; and a feedback circuit coupled to the pass transistor to provide a feedback voltage at the first input port of the error amplifier, the feedback voltage in response to the pass transistor providing an output voltage to the load.

20. The circuit of claim 19, further comprising:

a reference voltage source to provide a reference voltage at the second input port of the error amplifier; and an input voltage source to provide an input voltage at the source of the pass transistor.

* * * * *